US009976386B2

(12) United States Patent
Harris et al.

(10) Patent No.: US 9,976,386 B2
(45) Date of Patent: May 22, 2018

(54) METHOD AND APPARATUS FOR ACTUATING A DOWNHOLE TOOL

(71) Applicant: TEAM OIL TOOLS LP, The Woodlands, TX (US)

(72) Inventors: Michael J. Harris, Houston, TX (US); Kenneth J. Anton, Houston, TX (US)

(73) Assignee: TEAM OIL TOOLS, LP, The Woodlands, TX (US)

( * ) Notice: Subject to any disclaimer, the term of this patent is extended or adjusted under 35 U.S.C. 154(b) by 85 days.

(21) Appl. No.: 15/139,418

(22) Filed: Apr. 27, 2016

(65) Prior Publication Data

US 2016/0237786 A1 Aug. 18, 2016

Related U.S. Application Data

(63) Continuation of application No. 14/073,706, filed on Nov. 6, 2013, now Pat. No. 9,359,864, and a (Continued)

(51) Int. Cl.
*E21B 34/10* (2006.01)
*E21B 34/14* (2006.01)
(Continued)

(52) U.S. Cl.
CPC ..... *E21B 34/10* (2013.01); *E21B 34/06* (2013.01); *E21B 34/101* (2013.01);
(Continued)

(58) Field of Classification Search
CPC ..... E21B 34/125; E21B 34/12; E21B 34/08; E21B 34/085; E21B 34/102;
(Continued)

(56) References Cited

U.S. PATENT DOCUMENTS 5,979,553 A 11/1999 Brink
6,397,949 B1 6/2002 Walker
(Continued)

FOREIGN PATENT DOCUMENTS

WO 2013154544 A1 10/2013

OTHER PUBLICATIONS

Jin Ho Kim (Authorized Officer), PCT International Search Report and Written Opinion dated Feb. 24, 2015, PCT Application No. PCT/US2014/064365, dated Nov. 6, 2014, pp. 1-11.
(Continued)

*Primary Examiner* — Kenneth L Thompson
(74) *Attorney, Agent, or Firm* — MH2 Technology Law Group LLP

(57) ABSTRACT

The presently disclosed technique provides a method for operating a valve in a wellbore by: applying a first fluid pressure to a bore of the valve; trapping the first fluid pressure in a portion of the valve; reducing the pressure in the bore of the valve to a second fluid pressure thereby creating a pressure differential between the portion of the valve and the bore of the valve; and opening the valve responsive to the pressure differential. The valve may employ a first piston disposed in the body to trap a first fluid pressure in a chamber to create a differential pressure across a second piston when a second fluid pressure is applied to open the valve to fluid flow therethrough. The valve and the method may be used to actuate another valve downhole.

22 Claims, 11 Drawing Sheets

Related U.S. Application Data continuation of application No. PCT/US2014/064365, filed on Nov. 6, 2014.

(51) Int. Cl.

| | |
|---|---|
| ***F16K 27/04*** | (2006.01) |
| ***F16K 31/122*** | (2006.01) |
| ***E21B 34/06*** | (2006.01) |
| *E21B 34/00* | (2006.01) |

(52) U.S. Cl.

CPC ..... *E21B 34/102* (2013.01); *E21B 34/14* (2013.01); *E21B 34/063* (2013.01); *E21B 2034/007* (2013.01)

(58) Field of Classification Search

CPC ..... E21B 34/108; E21B 34/14; E21B 34/10; E21B 21/103; F16K 27/04; F16K 31/12; F16K 31/1225

USPC ..... 166/334.4; 251/12

See application file for complete search history.

(56) References Cited

U.S. PATENT DOCUMENTS

| | | | | |
|---|---|---|---|---|
| 7,204,315 | B2 | 4/2007 | Pia | |
| 7,503,390 | B2 | 3/2009 | Gomez | |
| 7,591,321 | B2 * | 9/2009 | Whitsitt | E21B 33/1272 166/187 |
| 8,267,178 | B1 | 9/2012 | Sommers | |
| 8,757,273 | B2 | 6/2014 | Themig | |
| 9,359,864 | B2 * | 6/2016 | Harris | E21B 34/101 |
| 9,476,282 | B2 * | 10/2016 | Anton | E21B 34/063 |
| 2009/0095463 | A1 | 4/2009 | Swan et al. | |
| 2012/0018169 | A1 | 1/2012 | Caminari et al. | |
| 2013/0087326 | A1 | 4/2013 | Ringgenberg | |

OTHER PUBLICATIONS

Notice of Allowance dated Nov. 18, 2015, U.S. Appl. No. 14/073,706, filed Nov. 6, 2013, pp. 1-17.

* cited by examiner

METHOD AND APPARATUS FOR ACTUATING A DOWNHOLE TOOL

CROSS-REFERENCE TO RELATED APPLICATIONS

This application is a continuation of U.S. patent application Ser. No. 14/073,706, filed Nov. 6, 2013, and a continuation of PCT Application No. PCT/US2014/64365, filed on Nov. 6, 2014. The entire disclosure of each of these applications is incorporated herein by reference.

STATEMENT REGARDING FEDERALLY SPONSORED RESEARCH OR DEVELOPMENT

Not applicable.

BACKGROUND

This section of this document introduces information from the art that may be related to or provide context for some aspects of the technique described herein and/or claimed below. It provides background information to facilitate a better understanding of that which is disclosed herein. This is a discussion of "related" art. That such art is related in no way implies that it is also "prior" art. The related art may or may not be prior art. The discussion in this section is to be read in this light, and not necessarily as admissions of prior art.

Oil, gas, and other fluids are extracted from the Earth by drilling wells into the ground. Historically, and in the popular imagination, these wells were drilled straight down into the ground—i.e., vertically. In the last few decades, however, drilling wells that significantly deviate from the vertical have become quite common. For convenience, such wells will be called "horizontal" wells herein since many of them actually are horizontal to the Earth's surface.

The process of finishing a well for production of the sought after fluid is frequently referred to as "completion". Completion often includes stimulation, or "fracking", the well to help increase its production. When constructing a horizontal, multi-stage completion of a hydrocarbon producing well, it is often desirable to conduct a casing pressure test prior to beginning the stimulation ("frac") process. The casing must be tested to the maximum anticipated treatment pressure. Current hydraulic opening initiator sleeves (toe shoes) require that the operator pressure up to their desired casing test pressure and then over to actually open the initiator sleeve (i.e., 10,000 psi test to 11,000 psi opening).

The presently disclosed technique is directed to resolving, or at least reducing, one or all of the problems associated with completion of a well. Even if solutions are available to the art to address these issues, the art is always receptive to improvements or alternative means, methods and configurations. Thus, there exists a need for a technique such as that disclosed herein.

SUMMARY

In a first aspect, a method for operating a valve in a wellbore comprises: applying a first fluid pressure to a bore of the valve; trapping the first fluid pressure in a portion of the valve; reducing the pressure in the bore of the valve to a second fluid pressure, thereby creating a pressure differential between the portion of the valve and the bore of the valve; and opening the valve responsive to the pressure differential.

In a second aspect, a valve comprises: a valve body defining a bore, a chamber, and a fluid passageway, the bore being in fluid communication with the chamber; a first piston disposed in the body to trap a first fluid pressure in the chamber when the first fluid pressure is applied to the bore of the body; and a second piston disposed in the body to open the fluid passageway in the valve body when a second fluid pressure is applied to the bore of the body, wherein the second fluid pressure is less than the first fluid pressure.

In a third aspect, a method of actuating a downhole tool in a wellbore, the downhole tool being actuated by a valve, comprises: pressuring up the wellbore to a first fluid pressure; trapping the first fluid pressure in a portion of the valve; reducing the pressure in the wellbore to a second fluid pressure thereby creating a pressure differential within the valve; opening a fluid passageway in the valve responsive to the pressure differential; and pumping fluid through the opened fluid passageway of the valve to actuate the downhole tool.

The above paragraphs present a simplified summary of the presently disclosed subject matter in order to provide a basic understanding of some aspects thereof. The summary is not an exhaustive overview, nor is it intended to identify key or critical elements to delineate the scope of the subject matter claimed below. Its sole purpose is to present some concepts in a simplified form as a prelude to the more detailed description set forth below.

BRIEF DESCRIPTION OF THE DRAWINGS

The invention may be understood by reference to the following description taken in conjunction with the accompanying drawings, in which like reference numerals identify like elements, and in which.

While the invention is susceptible to various modifications and alternative forms, the drawings illustrate specific embodiments herein described in detail by way of example. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Illustrative embodiments of the subject matter claimed below will now be disclosed. In the interest of clarity, not all features of an actual implementation are described in this specification. It will be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

The presently disclosed technique allows the operator to open a hydraulically actuated downhole tool at a predetermined pressure (equal to, greater than, or less than test pressure) by allowing the operator to pressure up to his test pressure, bleed the pressure off and then reapply pressure to open a sleeve. This is accomplished through a method of trapping pressure and creating a pressure differential during the bleed off cycle. This pressure differential then shifts the sleeve that exposes a pressure actuating device (e.g., a rupture disk) to casing pressure. A reapplication of pressure to the string activates the pressure actuating device and allows pressure to act on the shifting sleeve, this shifting sleeve in turn opens due to its own created pressure differential exposing stimulation ports in the wall of the tool housing.

Figure 1:
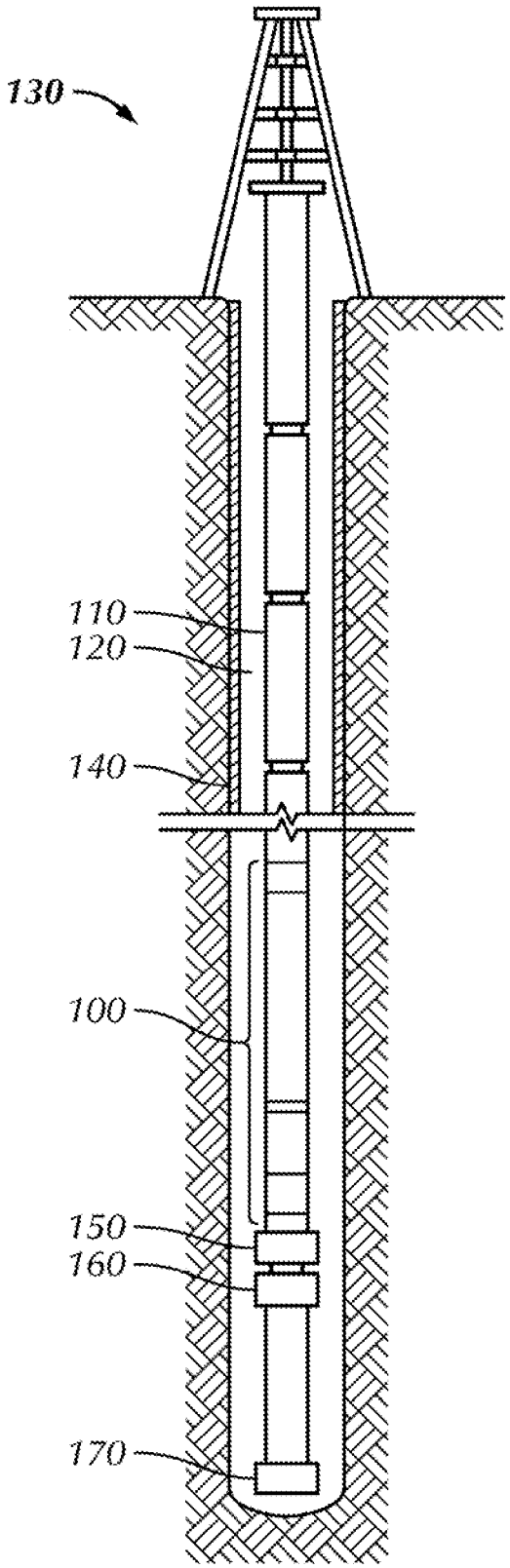
FIG. 1 conceptually depicts a tubular string deployed for downhole operations.

Turning now to FIG. 1, a downhole apparatus 100 is shown deployed as a part of a tubular string 110 in a wellbore 120 during a cementing operation 130. The downhole apparatus 100 may be run on a liner, a casing, tubing or any other string or pressure bearing pipe lowered into the well depending on the embodiment. Furthermore, although this particular embodiment is intended for a cementing operation, the presently disclosed approach can be used in un-cemented applications as well. Examples of such un-cemented applications include, but are not limited to, open hole implementations.

The wellbore 120 includes a casing 140 that ends at some predetermined point above the bottom of the wellbore 120, and so is an "open hole". The cementing operation 130 may be any kind of cementing operation encountered in the art. Those in the art will appreciate that cementing operations come in many variations depending on numerous factors such as the wellbore design, intended operations upon completion, the constitution of the formation in which the well is drilled, and applicable regulations. Accordingly, the embodiments disclosed herein are not limiting and are exemplary only. The technique currently disclosed and claimed is amenable to all manner of operations and variable to meet these types of concerns.

The length and composition of the tubular string 110 will be highly implementation specific and is not material to the practice of the technique. The downhole apparatus 100 is disposed in accordance with conventional practice toward the end of the tubular string 110. The downhole apparatus 100 may be, for example, three or four joints from the bottom of the casing 140 or the tubular string 110. The joints below the downhole apparatus 100 may include but is not limited to a landing collar 150, a float collar 160, a float shoe 170, or some combination of these depending on the embodiment.

Figure 2:
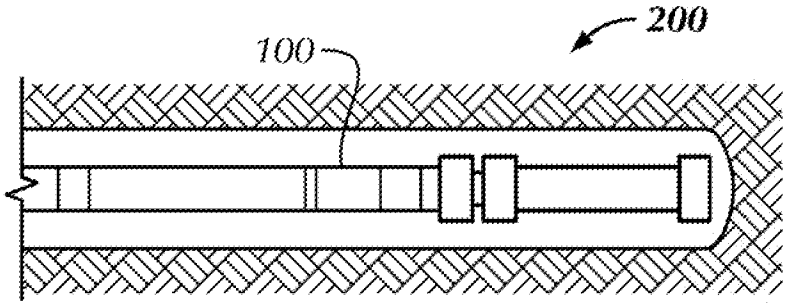
FIG. 2 conceptually depicts a tubular string deployed for downhole operations in an embodiment alternative to that shown in FIG. 1.

The embodiment shown in FIG. 1 is a vertical well. However, the presently disclosed technique is equally applicable to horizontal wells. This is, in fact, expected to be the typical application. A portion of one such horizontal well 200 is shown in FIG. 2. The horizontal well 200 may be produced by directional drilling or may be the result of drilling a deviated well, or some combination of these techniques. The present invention is indifferent to the manner in which the well is drilled.

In the description that follows, the terms "upper" or "lower" are used to identify that which is closer and farther, or proximal and distal, to and from the wellhead at the Earth's surface as traced through the wellbore. This accords with their usage in the art. The same is true for similar terms such as "uphole" and "downhole" when used in such a context. Thus, in embodiments where the wellbore is horizontal and the components are not necessarily "above" or "below" each other in the sense one might find in a vertical wellbore, they will still be proximal or distal to the wellhead through the wellbore and so the terms "upper", "lower", "uphole", and "downhole" still apply.

Figure 3:
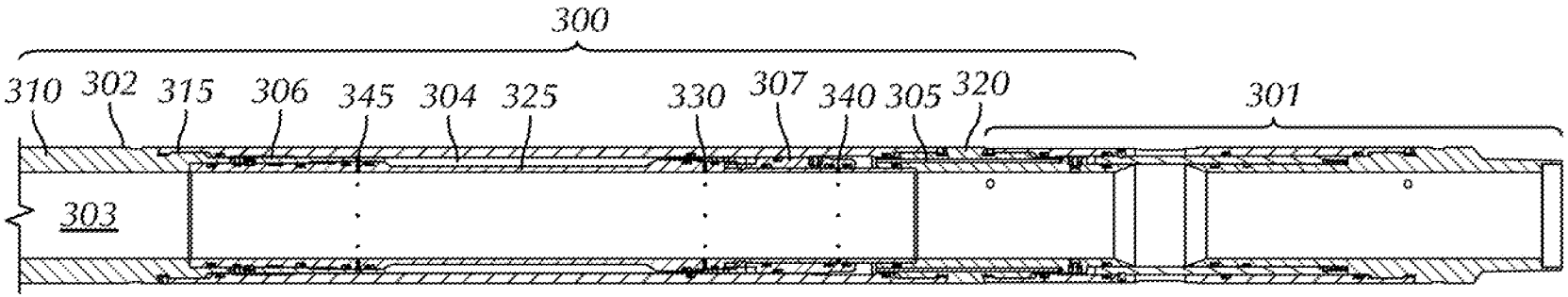
FIG. 3 depicts a downhole apparatus in accordance with one particular embodiment of the presently disclosed technique in a sectioned view.

FIG. 3 presents a first particular embodiment of the downhole apparatus 100 first shown in FIG. 1. In this particular embodiment, the downhole apparatus 100 comprises a valve 300 and a hydraulically actuated downhole tool 301. The downhole tool 301 is, in this particular embodiment, a toe valve. The presently disclosed technique admits wide latitude as to the implementation of the hydraulically actuated downhole tool. One particular implementation of a toe valve will be discussed below, but it is to be understood that the presently disclosed technique may be used with any suitable hydraulically actuated downhole tool known to the art.

The valve 300 comprises a valve body 302 defining a bore 303 in fluid communication with a chamber 304 and a fluid passageway 305. The valve 300 also includes a first piston 306 and a second piston 307. The first piston 306 is disposed in the body 302 to trap a first fluid pressure in the chamber 304 when the first fluid pressure is applied to the bore 303 of the body 302. The second piston 307 is disposed in the body 302 to open the fluid passageway 305 when a second fluid pressure is applied to the bore 303 of the body 302, wherein the second fluid pressure is less than the first fluid pressure.

More particularly, the valve body 302 comprises in this embodiment an upper sub 310, a housing 315, a lower sub 320, and an inner mandrel 325. The housing 315 is mechanically engaged at either end thereof to the upper sub 310 and the lower sub 320. The mechanical engagement may be by any suitable means known to the art. The illustrated embodiment effects the mechanical engagement through mating threads such is well known and commonly used throughout the art. However, other suitable means may be employed in alternative embodiments. The inner mandrel 325 is disposed within the housing 315 between the upper sub 310 and the lower sub 320. The inner mandrel 325 abuts the upper sub 310 and the lower sub 320 on either end but does not engage them by mating thread, pins, welds, or any other such technique in this particular embodiment.

The inner mandrel 325, in conjunction with the housing 315, defines the chamber 304. The chamber 304 is in direct fluid communication with the bore 303 and a first port 345 and indirect fluid communication with a second port 330 and a third port 340 through the bore 304, all in the inner mandrel 325. As is better shown in FIG. 4A-FIG. 4B, the first port 345, second port 330, and third port 340 each comprises at least one radial port 400 (only one indicated). The number of radial ports 400 is implementation specific and can range from as low as one to virtually any higher number. Those in the art having the benefit of this disclosure will appreciate, however, that there are practical considerations in the design of such a tool that will mitigate against excessively large numbers of ports. Similarly, the geometry need not necessarily be circular and the distribution need not necessarily be uniform in alternative embodiments.

Some of the details described herein are implementation specific and so may see wide variation across different embodiments. This includes details such as the fit of the inner mandrel 325 to the upper sub 310 and the lower sub 320 and the number. Such details may be employed to, for example, facilitate manufacture and assembly of the valve 300. This also includes details such as the number and distribution of radial ports 400 in the first port 345, second port 330, and third port 340. However, other considerations familiar to those in the art, or even these particular considerations weighed differently or examined in a different context, might mitigate for departure from such details. The presently disclosed technique therefore admits variation in such details.

Figure 4A:
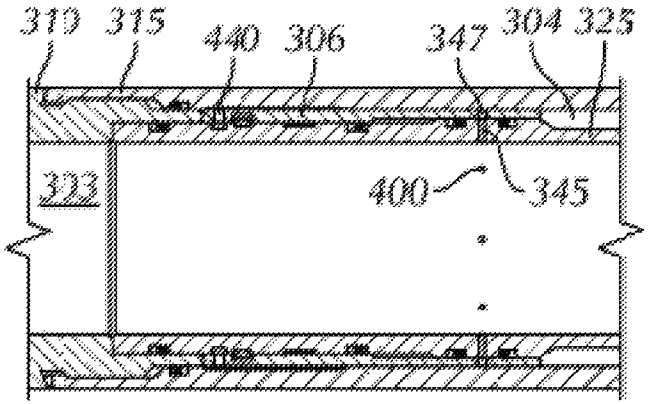
FIG. 4A-FIG. 4B, FIG. 5A-Figure SB.
Figure 4B:
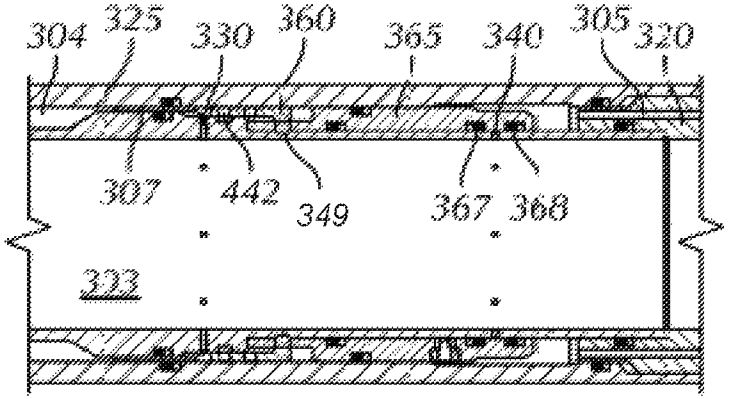

Returning now to FIG. 3, there are two pistons disposed in the chamber 304 about the inner mandrel 325, as shown better in FIG. 4A-FIG. 4B. The first piston 306, shown in FIG. 4A, is a check piston. The second piston 307, shown in FIG. 4B, comprises a lock piston 360 and a bypass piston 365. The pistons move responsive to fluid pressure and to control fluid pressure within the valve 300 as will be described hereafter.

The toe valve 301 may be any suitable toe valve known to the art. In the illustrated embodiment, the toe valve 301 is the toe valve disclosed and claimed in U.S. application Ser. No. 13/924,828. However, it is to be understood that other suitable toe valves known to the art may be used in alternative embodiments. A fuller description of the design, construction and operation of the illustrated toe valve 301 can be found in the aforementioned application. For present purposes, the toe valve 301 is initiated by fluid pressure through the fluid passageway 305 to move a sliding sleeve and uncover ports permitting fluid flow from the bore 303 to the exterior of the tubular string 110.

FIG. 3 and FIG. 4A-FIG. 4B depict the downhole apparatus 100 as it is run into the wellbore 120 as shown in FIG. 1 or FIG. 2. The wellbore 120, shown in FIG. 1, and the bore 303, shown in FIG. 3, at this time are at an ambient pressure, which will typically be a hydrostatic pressure resulting from the weight of the fluid in the wellbore 120. The first piston 306 is shown in its open position in FIG. 4A. The lock piston 360 of the second piston 307, as shown in FIG. 4B, is in its locked position. The bypass piston 365 is in its safe position and is locked to the inner mandrel 325 by a locking dog 349.

The first piston 306 is pinned to the inner mandrel 325 by a shear pin 440 and the lock piston 360 is pinned to the inner mandrel 325 by a shear pin 442. The shear pins 440, 442 prevent inadvertent shifting of the first piston 306 and the second piston 307. The shear pins 440, 442 are, by way of example and illustration, but one means by which the inadvertent shifting of the first piston 306 and the lock piston 360 may be accomplished. Other suitable means are known to the art for performing this function. For example, the shear pins may be shear wires, screws, or some other device. Any suitable means known to the art may be used for this purpose and alternative embodiments may employ any such suitable means.

The chamber 304 is exposed to the fluid pressure in the bore 303 through the first port 345 and the aligned port 347 in the first piston 306. Thus, when the downhole apparatus 100 is run into the wellbore 120 as a part of the tubular string 110, the pressure in the chamber 304 is the ambient pressure in the wellbore 120 and the bore 303. The pressure across the lock piston 360 is balanced by the application of the fluid pressure in the bore 303 through the second port 330. Note that the third port 340 is closed by the bypass piston 365 and sealed by the sealing elements 367, 368.

Figure 9:
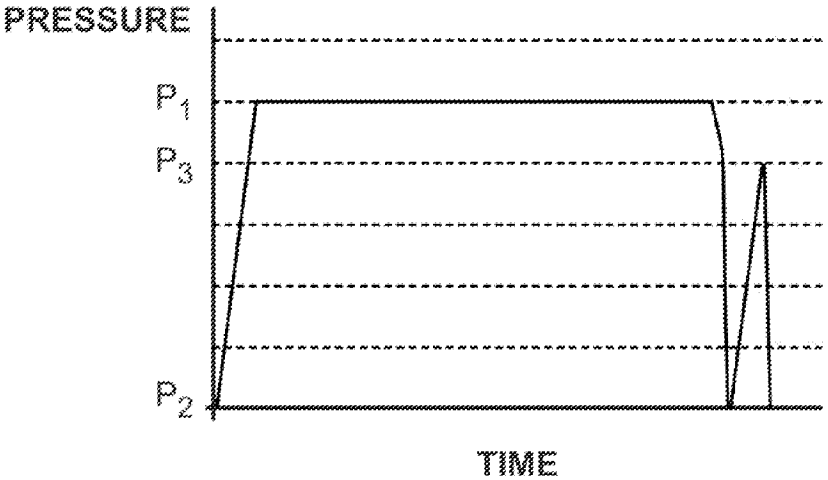
FIG. 9 illustrates the pressure cycling in the wellbore during the operation of the downhole apparatus.

Once the tubular string 110 is disposed within the wellbore 120, the wellbore 120 is pressured up to a first fluid pressure ($P_1$) in accordance with conventional practice, as is shown in FIG. 9. This will typically be a part of the casing pressure test, and so the first fluid pressure will be the casing test pressure. Those in the art will appreciate that this test is ordinarily governed by regulation and that the parameters set for the test by regulation will vary by the location of the well.

These parameters include not only the pressure to which the well must be brought up to, but also the time during which it must be held at that pressure. Thus, even in embodiments in which the first fluid pressure is the testing pressure, that pressure will vary depending on the implementation. Similarly, the time at which the well is held at the first fluid pressure will also vary depending on the implementation. Those in the art having the benefit of this disclosure will be able to readily ascertain those parameters for their particular implementation.

Figure 5A:
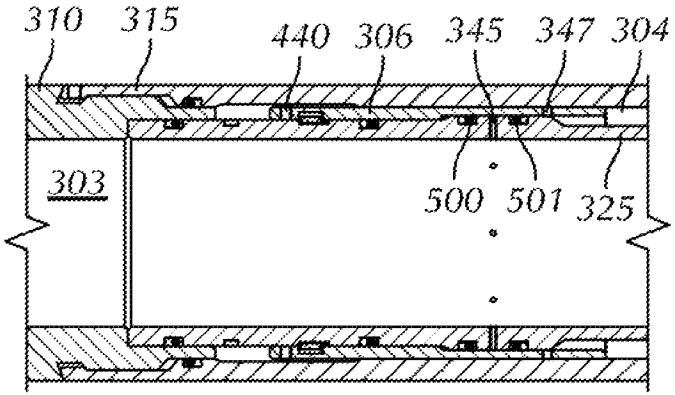

The chamber 304, because it is in fluid communication with the bore 303 as described above, will pressure up to the first fluid pressure ($P_1$) along with the rest of the well. The shear pin 440 holding the first piston 306 is selected to shear at the first fluid pressure. When the shear pin 440 shears as the well pressure reaches the first fluid pressure, the first piston 306 moves to a closed position as shown in FIG. 5A. The first piston 306 may be held in this closed position by a locking or latching mechanism 311 to prevent it from moving at this point in some embodiments. The movement of the first piston 306 disturbs the alignment between the first port 345 and the aligned port 347. The first port 345 is then otherwise sealed by the sealing elements 500, 501.

The movement of the first piston 306 to its closed position thereby interrupts the fluid communication between the bore 303 and the chamber 304 through the first port 345. The second piston 307, however, is still held in position by the second shear pin 442 as is shown in Figure SB. The pressure across the lock piston 360 is still balanced through the second port 330. The pressure in the bore 303 and the chamber 304 is at the first fluid pressure at this point in the operation. As described above, the closure of the first piston 306 seals the chamber 304 from the first port 345. The chamber 304 is furthermore sealed on its other end by the sealing elements 504, 505. Thus, the first fluid pressure is "trapped" within the chamber 304, i.e., in that portion of the valve 300.

Figure 6:
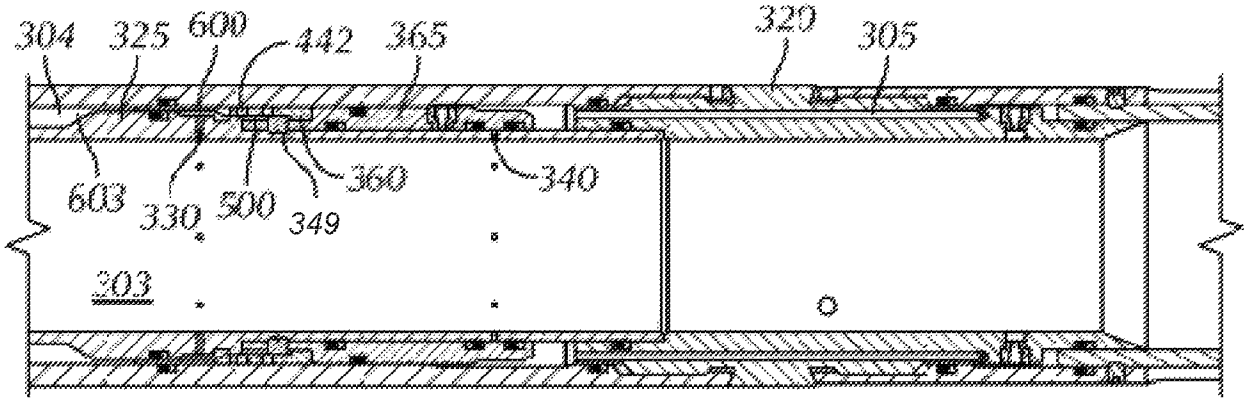
FIG. 6-FIG. 8 depict portions of the downhole apparatus of FIG. 3 during various stages of operation.

The pressure in the wellbore 120 is then brought down to a second fluid pressure ($P_2$) less than the first fluid pressure as shown in FIG. 9. Turning now to FIG. 6, in the illustrated embodiment, the pressure in the portion 600 of the chamber 304 is bled out through the second port 330 as the pressure in the bore 303 is reduced. The portion 603 in which the first fluid pressure is trapped, however, is sealed at both ends as described above, and so remains at the first fluid pressure. This creates a differential pressure across the lock piston 360 that shears the pin 442, thereby permitting the lock piston 360 to stroke downward, which is to the right in the drawings, so that the lock piston 360 abuts against the bypass piston 365 as shown.

Figure 5B:
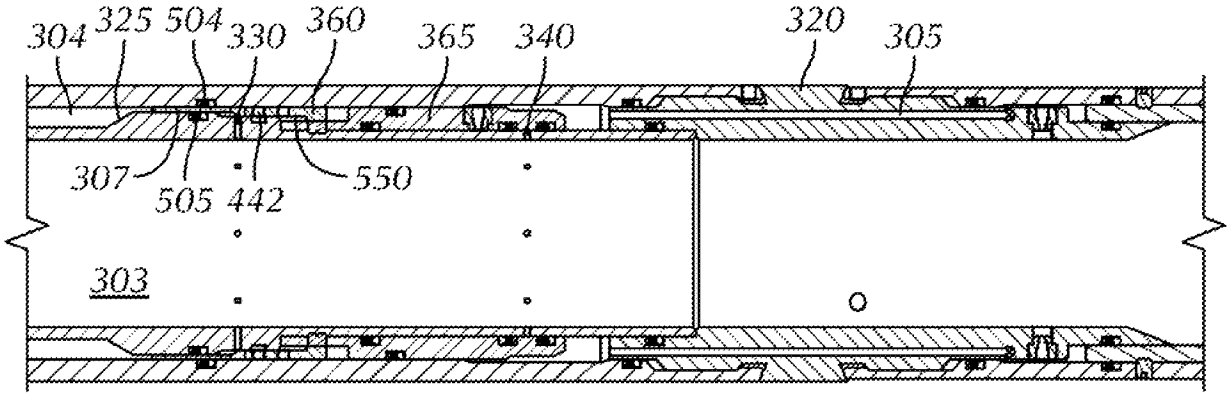

Still referring now to FIG. 6, when the lock piston 360 strokes downward, a recess 550, best shown in FIG. 5B, aligns with the locking dog 349. This allows the locking dog 349 to expand radially into the recess 550 to unlock the bypass piston 365 from the inner mandrel 325 and lock the bypass piston 365 to the lock piston 360. The differential pressure continues to act on the lock piston 360 while the pressure continues to bleed off through the second port 330. The lock piston 360 continues to stroke downward, taking the bypass piston 365 with it through the engagement provided by the locking dog 349 as shown in FIG. 7.

Figure 7:
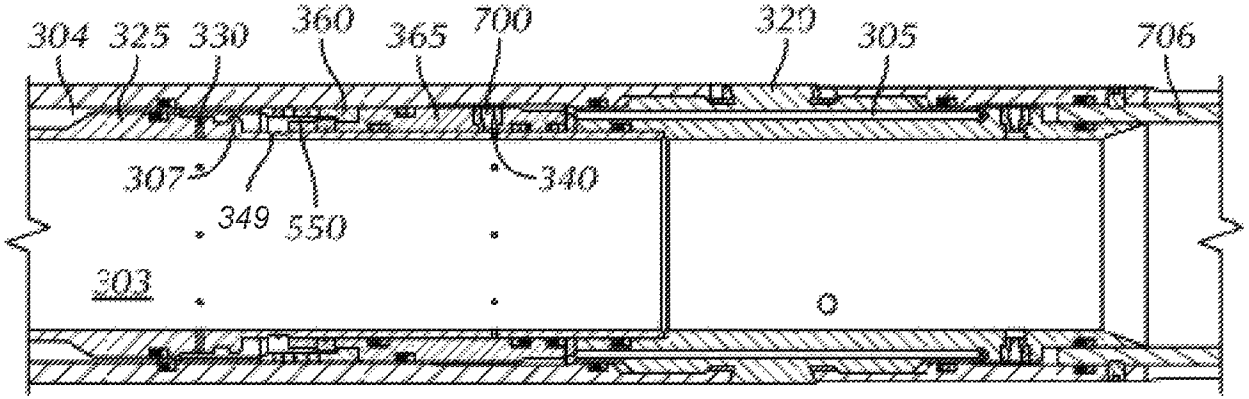

Still referring to FIG. 7, when the second piston 307—i.e., the lock piston 360 and bypass piston 365-finishes the downward stroke, the wellbore 120 and the bore 303 are at the second fluid pressure. The downward stroke aligns a port 700 in the second piston 307 with the third port 340. This opens the valve 300 by permitting fluid communication from the bore 303 through the aligned ports 340, 700 and into the fluid passageway 305. Thus, the valve 300 is opened responsive to the pressure differential across the lock piston 360 from the trapped first fluid pressure when the pressure in the bore 303 is reduced to the second fluid pressure.

In the illustrated embodiment, the wellbore 120 is then pressured up again to a third fluid pressure ($P_3$) greater than the second fluid pressure as shown in FIG. 9. In the illustrated embodiment, this third fluid pressure is not as great as the first, but this may not be true in some embodiments. The third fluid pressure may be as great or greater than the first fluid pressure in some alternative embodiments.

Figure 8:
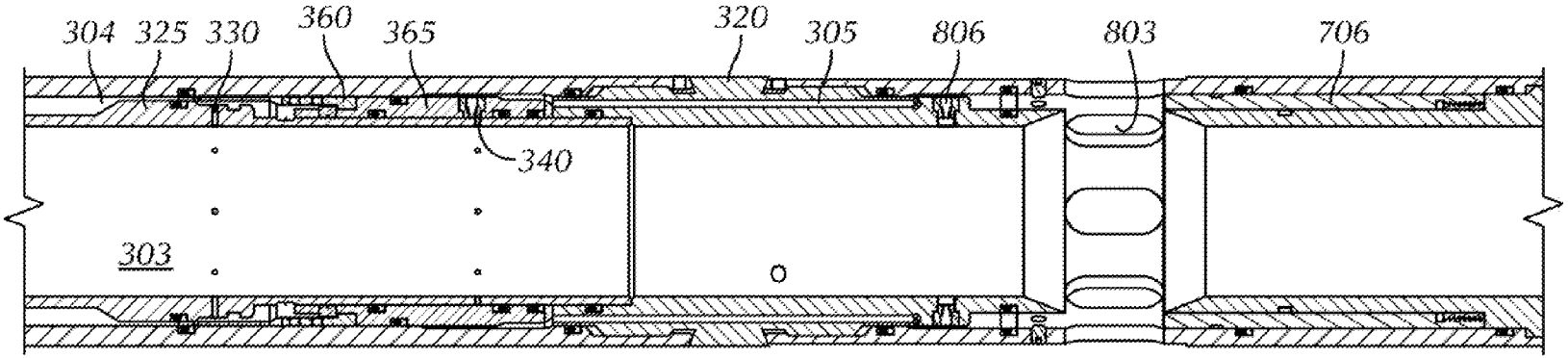

The third fluid pressure then acts through the fluid passageway 305 to actuate the toe valve 301. Note that the actuation of the toe valve 301 will depend to some degree on the implementation thereof. In the illustrated embodiment, the third fluid pressure acts through the fluid passageway 305 to move the sliding sleeve 706, shown in both FIG. 7 and FIG. 8. This moves the sliding sleeve 706 from its closed position partially shown in FIG. 7 to its open position, shown in FIG. 8, to expose the ports 803 (only one indicated) of the toe valve 301. This movement, then, opens the toe valve 301 and permits fluid flow through the bore 303 to the external annulus surrounding the downhole apparatus 100 in the wellbore 120.

The fluid used to open the toe valve 301 may be any fluid used in the art in such circumstances. The pressures at which the toe valve 205 opens will be implementation specific depending on operating regulations governing operations on the well. However, pressures on the order of 17,000 psi will not be uncommon.

This particular embodiment also includes a "failsafe" mode of operation. This mode of operation could be employed if, for example, some error happens in the function of the pistons in a manner that prohibits the delivery of the third fluid pressure through the fluid passageway 305. The fluid passageway 305 is protected by a pressure barrier 806, shown in FIG. 8, which will permit fluid communication with the bore 303 directly from the bore 303. Should the intended operation of the valve 300 described above go awry, the well operator can circumvent it by pressuring up the wellbore 120 to a suitably high fourth fluid pressure that will cause the pressure barrier 806 to give way. This will then permit fluid flow into the second port 330 and delivery of the fourth pressure to the toe valve 301. However, some embodiments may omit this feature.

In the illustrated embodiment, the valve 300 and the toe valve 301 are manufactured as separate tools that are assembled prior to use. Alternative embodiments, however, may manufacture the features of each in a single tool for assembly into a string. This true also even in embodiments in which the hydraulically actuated downhole tool is a tool other than a toe valve. Other, similar variations may become apparent to those ordinarily skilled in the art having the benefit of this disclosure.

Figure 10A:
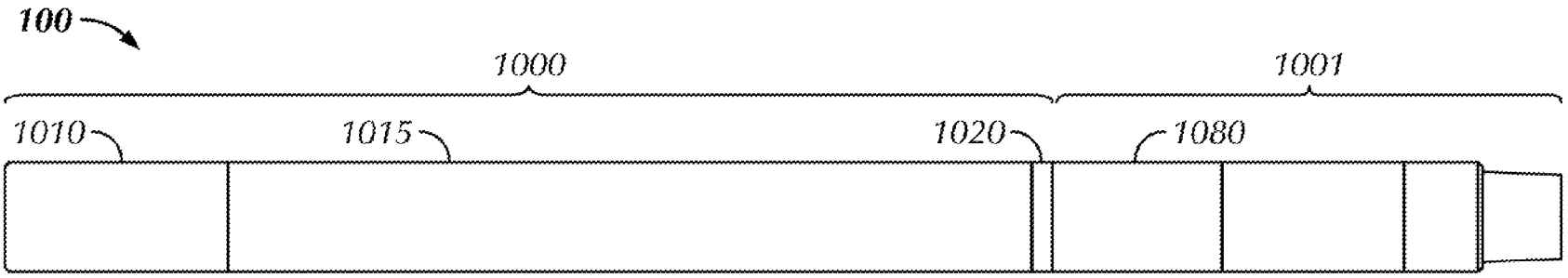
FIG. 10A-FIG. 10B depict a downhole apparatus in accordance with a second particular embodiment of the presently disclosed technique in isometric and sectioned views, respectively.
Figure 10B:
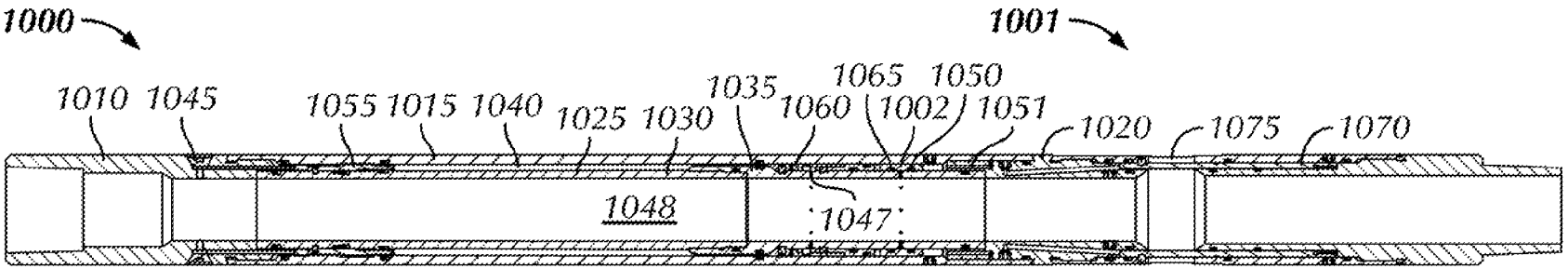

The presently disclosed technique admits variation in the design of the valve 300 in alternative embodiments. One such alternative embodiment is shown in FIG. 10A and FIG. 10B in an isometric and a sectioned view, respectively. The downhole apparatus 100 comprises, in this particular embodiment, and valve 1000 and a hydraulically actuated downhole tool, which in this particular embodiment is the toe valve 301 discussed above.

Referring now to FIG. 10A, the valve 1000 comprises an upper sub 1010, an upper housing 1015, and a lower sub 1020. The housing 1015 is mechanically engaged at either end thereof to the upper sub 1010 and the lower sub 1020. The mechanical engagement may be by any suitable means known to the art. The illustrated embodiment effects the mechanical engagement through mating threads such is well known and commonly used throughout the art. However, other suitable means may be employed in alternative embodiments.

As shown in FIG. 10B, the valve 1000 also includes an inner mandrel 1025 disposed within the upper housing 1015 between the upper sub 1010 and the lower sub 1020. The inner mandrel 1025 abuts the upper sub 1010 and the lower sub 1020 on either end but does not engage them by mating thread, pins, welds, or any other such technique in this particular embodiment. The inner mandrel 1025 in this particular embodiment also comprises an upper inner mandrel 1030 and a lower inner mandrel 1035 that are mechanically engaged through mating threads.

The inner mandrel 1025, in conjunction with the upper housing 1015, defines a chamber 1040. The chamber 1040 is in fluid communication with the bore 1048 through a first port 1045 in the upper sub 1010. As better shown in FIG. 11A, the first port 1045 comprises a radial port 1100 and an axial port 1105. To facilitate manufacturing, the first port 1045 extends through the wall of the upper sub 1010 but, prior to use, is sealably plugged on the outside by the plug 1101. Note that there are in fact two first ports 1045 in this particular embodiment.

The chamber 1040 is also, at various times during the operation of the valve 1000, in fluid communication with the bore 1048 through a second port 1047. Each second port 1047 comprises a radial port through the inner mandrel 1025.

Figure 11A:
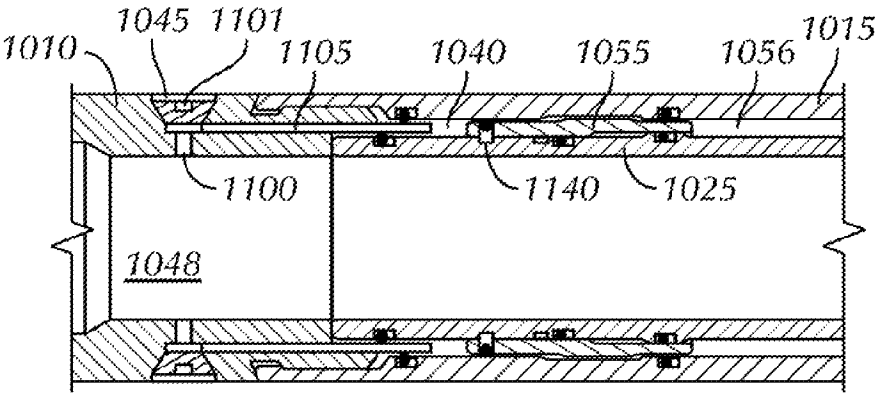
FIG. 11A-FIG. 11B, FIG. 12A-FIG. 12B, and FIG. 13-FIG. 15 depict portions of the downhole apparatus of FIG. 10A-FIG. 10B during various stages of operation.
Figure 11B:
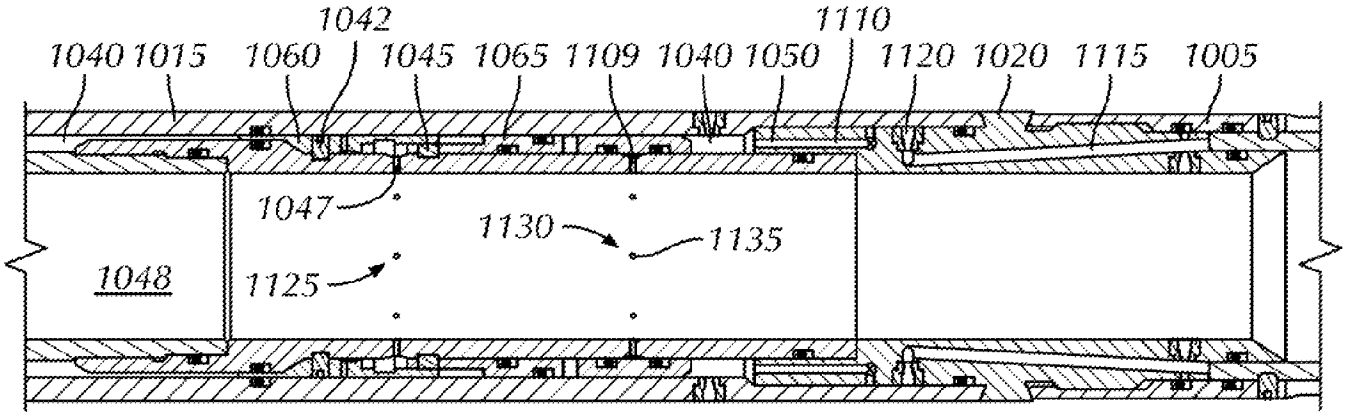

The third port 1050 is better shown in FIG. 11B and comprises, in this particular embodiment, a radial port 1109. The third port 1050 is in fluid communications with a fluid passageway 1051 comprised of two axial ports 1110, 1115. The fluid passageway 1051 is protected by a pressure barrier 1120, such as a rupture disk, a check valve, or a pressure relief valve between the two axial ports 1110, 1115. The pressure barrier 1120, when intact, seals the axial ports 1110, 1115 from one another, but when overcome, the axial ports 1110, 1115 are in fluid communication.

Still referring to FIG. 11B, the inner mandrel 1025 defines a first set 1125 and a second set 1130 of radial ports 1135 (only one indicated). These radial ports 1135 comprise the second port 1047 and the third port 1050 in this particular embodiment. The number of radial ports 1135 in each of the sets 1125, 1130 is implementation specific and can range from as low as one to virtually any higher number. Those in the art having the benefit of this disclosure will appreciate, however, that there are practical considerations in the design of such a tool that will mitigate against excessively large numbers of ports. Similarly, the geometry need not necessarily be circular and the distribution need not necessarily be uniform in alternative embodiments.

Returning now to FIG. 10B, a first piston 1055 and a second piston 1002 are disposed in the chamber 1040 about the inner mandrel 1025. The first piston 1055 is again a check piston and is disposed about the upper inner mandrel 1030. The second piston 1002 comprises a lock piston 1060 and a bypass piston 1065, both of which are disposed about the lower inner mandrel 1035. The pistons move responsive to fluid pressure and to control fluid pressure as will be described hereafter.

FIG. 10A-FIG. 10B depict the downhole apparatus 100 as it is run into the wellbore 120 as shown in FIG. 1 or FIG. 2. The wellbore 120, shown in FIG. 1, and the bore 1048, shown in FIG. 10B, at this time are at an ambient pressure, which will typically be a hydrostatic pressure resulting from the weight of the fluid in the wellbore. The check piston 1055 is shown in its open position in FIG. 11A. Note that the check piston 1055 is pinned to the inner mandrel 1025 by a shear pin 1140 to prevent inadvertent shifting. The lock piston 1060, as shown in FIG. 11B, is in its locked position and also pinned to the inner mandrel 1025 to prevent inadvertent shifting by a shear pin 1142. Still referring to FIG. 11B, the bypass piston 1065 is in its safe position. Its position is held relative to the inner mandrel 1025 by a locking dog 1145.

The check piston 1055 does not seal the chamber 1040 in the position shown in FIG. 11A. The chamber 1040 is therefore exposed to the fluid pressure in the bore 1048 through the first port 1045. Thus, when the downhole apparatus 100 is run into the wellbore 120 as a part of the tubular string 110, the pressure in the chamber 1040 is the ambient pressure in the wellbore 120 and the bore 1048.

Figure 12A:
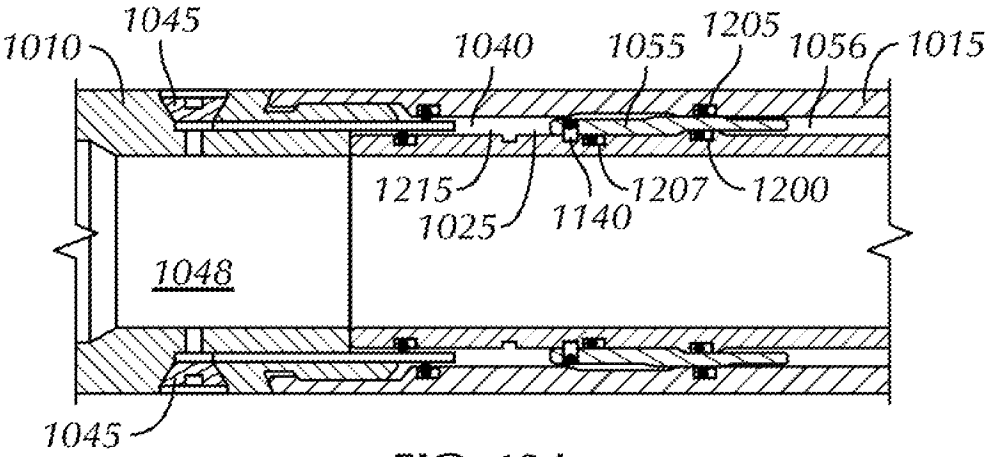

Once the tubular string 110 is disposed within the wellbore 120, the wellbore 120 is pressured up to a first fluid pressure ($P_1$) in accordance with conventional practice, as is shown in FIG. 9. The chamber 1040, because it is in fluid communication with the bore 1048, will pressure up to the first fluid pressure along with the rest of the well. The shear pin 1140 holding the check piston 1055 is selected to shear at the first fluid pressure. When the shear pin 1140 shears as the well pressure reaches the first fluid pressure, the check piston 1055 moves to a closed position as shown in FIG. 12A. The lock piston 1060 and the bypass piston 1065 do not shift because they are still pinned or locked to the inner mandrel 1025.

The sealing elements 1200, 1205, 1207—elastomeric O-rings, in this particular embodiment—seal the portion 1056 of the chamber 1040 below the check piston 1055 from that portion 1215 above the check piston 1055. In particular, they seal against the face of the check piston 1055. Thus, whereas fluid flow was previously permitted between the bore 1048 and the chamber 1040 around the check piston 1055, such fluid flow is sealed by the downward movement of the check piston 1055 to seal the chamber 1040 below the check piston 1055 from the bore 1048. The portion 1056 is sealed below by the sealing elements 1215, 1220, shown in FIG. 12B—again, elastomeric O-rings in this embodiment. The pressure in the portion 1056 is thereby sealed at the first fluid pressure such that the first fluid pressure is trapped in the portion 1056 as it is isolated by the downward movement of the check piston 1055. Note that, as shown in FIG. 12B, the lock piston 1060 and the bypass piston 1065 are in their locked position and safe position, respectively.

The pressure in the wellbore 120 is then brought down to a second pressure less than the first fluid pressure. In the illustrated embodiment, the pressure in the portion 1225 of the chamber 1040 is bled out through second port 1050. The portion 1056, however, is sealed at both ends as described above, and so remains at the first fluid pressure. This creates a differential pressure across the lock piston 1060 that shears the pin 1142, thereby permitting the lock piston 1060 to stroke downward, which is to the right in the drawings, as shown in FIG. 13.

Figure 12B:
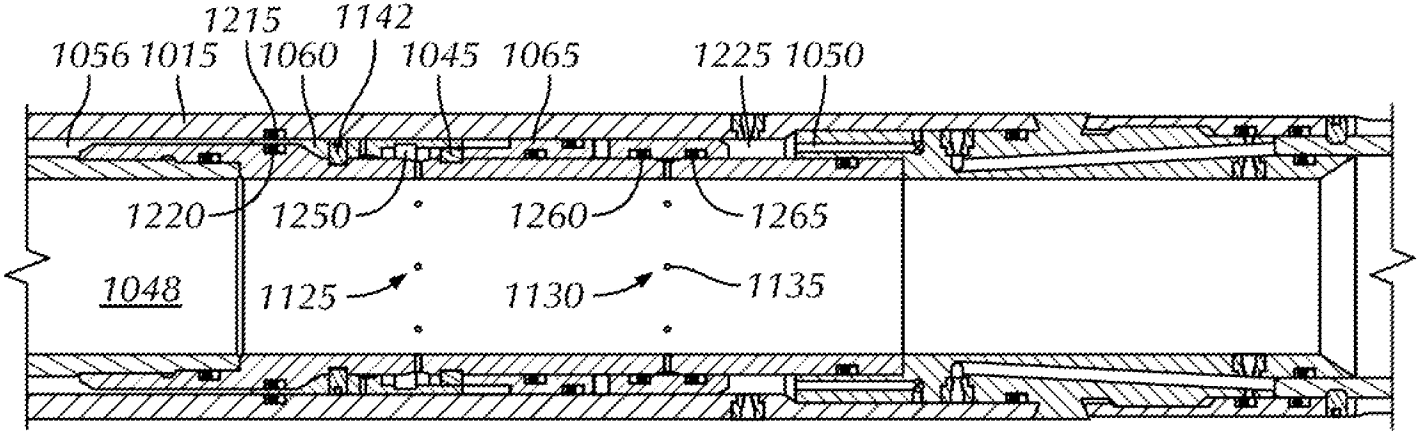
Figure 13:
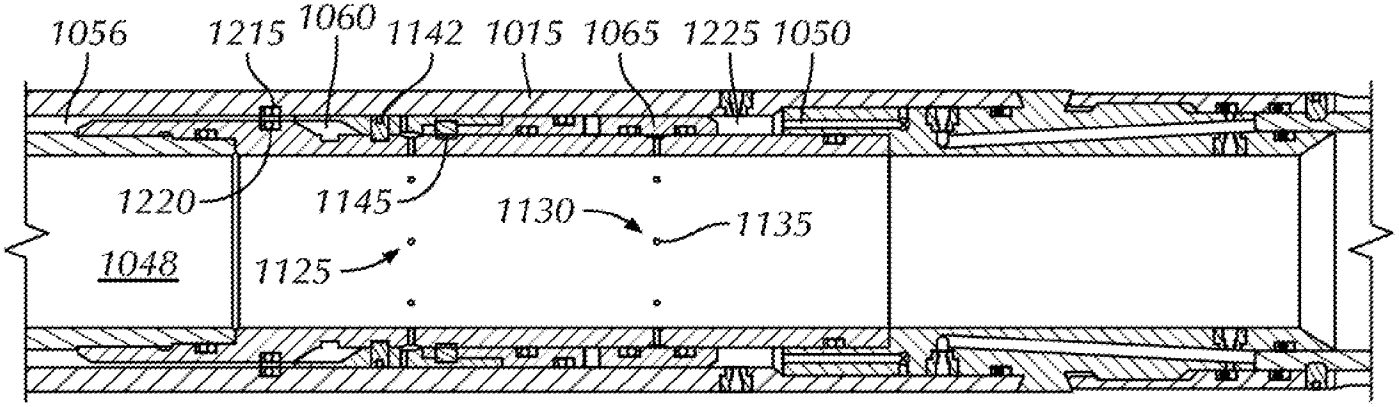
Figure 14:
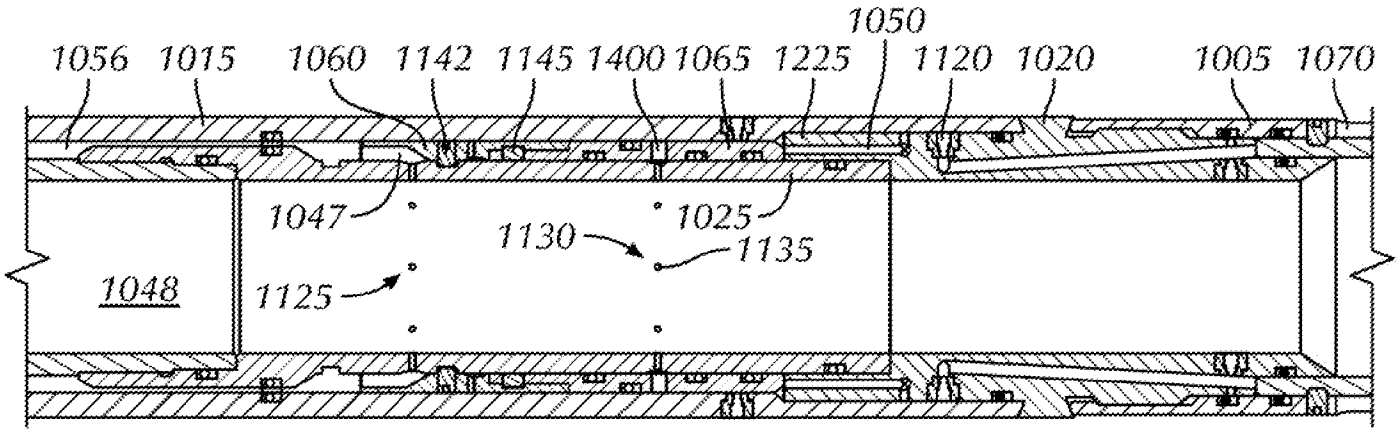

Referring now to both FIG. 12B and FIG. 13, when the lock piston 1060 strokes downward, a recess 1250, best shown in FIG. 12B, aligns with the locking dog 1145. This allows the locking dog 1145 to expand radially into the recess 1250 to unlock the bypass piston 1065 from the inner mandrel 1025 and lock the bypass piston 1065 to the lock piston 1060. The differential pressure continues to act on the lock piston 1060 while the pressure continues to bleed off through the second port 1047. The lock piston 1060 continues to stroke downward, taking the bypass piston 1065 with it through the engagement provided by the locking dog 1145. When the lock piston 1060 and bypass piston 1065 finish the downward stroke, as shown in FIG. 14, a plurality of ports 1400 therein align with the radial ports 1135 of the third port 1050 in the inner mandrel 1025. This opens the fluid passageway 1051 to fluid flow from the bore 1048.

Figure 15:
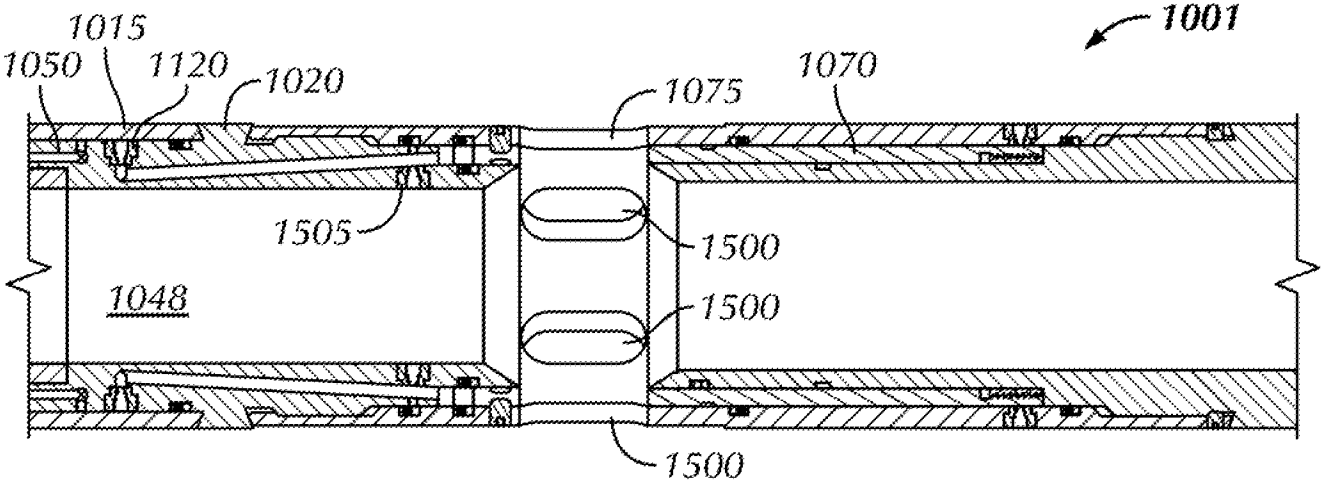

The wellbore 120 is then pressured up again to a third fluid pressure greater than the second pressure as shown in FIG. 9. Referring now to both FIG. 14 and FIG. 15, the pressure at this point is communicated from the bore 1058 to the third port 1050 through the second set 1020 of radial ports 1135 in the inner mandrel 1025 and the aligned ports 1400 in the bypass piston 1065. As mentioned above, the third port 1050 is protected by a pressure barrier 1100, which is a burst disk in this particular embodiment. The pressure barrier 1120 is preselected to give way at the third fluid pressure. When the pressure barrier 1120 gives way, the third fluid pressure is then applied to the sliding sleeve 1070 of the toe valve 301. The sliding sleeve 1070 then moves from its closed position, shown partially in FIG. 14, to its open position, shown in FIG. 15, to expose the ports 1075 of the toe valve 301.

This particular embodiment also includes a "failsafe" mode of operation in the same manner as the embodiment of FIG. 3A-FIG. 8. The third port 1050 is protected by a second pressure barrier 1505, shown in FIG. 15, which will permit fluid communication with the bore 1048 via a second path. The well operator can pressure up the wellbore 120 to a suitably high fourth pressure that will cause the pressure barrier 1505 to give way and permit fluid flow to the toe valve 301.

The illustrated embodiment may include a shroud 1080, shown only in FIG. 10A. The shroud 1080 covers the ports of the toe valve 301 during deployment and operations to help prevent the ports 1075 from fouling and manage pressures in the bore 303. The shroud 380 can be designed to fall away during operations upon experiencing some particular pressure. For example, in one embodiment, the shroud 380 breaks upon opening the toe valve 301 and applying a breakdown pressure to the shroud 380, the cement, and the formation. Again, some embodiments may omit this feature.

Other non-limiting similarities to the embodiment of FIG. 3A-FIG. 8 may also be found. For example, although the valve 1000 and the toe valve 301 are manufactured as separate tools and assembled prior to use, alternative embodiments, however, may manufacture the features of each in a single tool for assembly into a string. Other, similar variations may become apparent to those ordinarily skilled in the art having the benefit of this disclosure.

The following patents and/or patent applications are hereby incorporated by reference in their entirety for all purposes as if expressly set forth herein.

U.S. application Ser. No. 13/924,828, entitled, "Method and Apparatus for Smooth Bore Toe Valve", filed Jun. 24, 2013, in the name of the inventors Kenneth J. Anton and Michael J. Harris and commonly assigned herewith.

In the event of any conflict between any incorporated patent, patent application, or other reference and the disclosure herein, the present disclosure controls the conflict.

This concludes the detailed description. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A downhole apparatus, comprising:

a body defining a bore and a chamber;

a first piston; and a second piston, wherein the first piston is movable from an open position to a closed position, the first piston in the open position permitting fluid communication between the bore and the chamber, the first piston in the closed position preventing fluid communication past the first piston, between the bore and the chamber, and wherein the second piston is movable at least partially in response to a pressure differential between the bore and the chamber.

2. The downhole apparatus of claim 1, wherein the chamber is defined at least partially between the first and second pistons.

3. The downhole apparatus of claim 1, wherein the body further defines a first port in communication with the bore, the first piston in the open position permitting fluid communication between the chamber and the bore via the first port, and the first piston in the closed position preventing fluid communication through the first port.

4. The downhole apparatus of claim 1, further comprising a shear mechanism coupled to the body and the first piston in the open position, wherein the shear mechanism is configured to shear in response to a pressure in the bore that is communicated to the chamber.

5. The downhole apparatus of claim 4, further comprising a latching mechanism coupled to the body and the first piston, wherein the latching mechanism permits the first piston to move from the open position to the closed position, and prevents the first piston from moving from the closed position to the open position.

6. The downhole apparatus of claim 1, wherein the second piston is movable from a first position to a second position, the second piston in the first position preventing fluid communication past the second piston and into the chamber, the second piston in the second position permitting fluid communication with the chamber.

7. The downhole apparatus of claim 6, wherein the chamber is sealed from fluid communication with the bore when the first piston is in the closed position and the second piston is in the first position, so as to trap a fluid pressure within the chamber and generate the pressure differential.

8. The downhole apparatus of claim 6, wherein the body defines a second port in communication with the bore, and wherein a pressure in the bore is communicated to the second piston via the second port.

9. The downhole apparatus of claim 8, wherein the second piston comprises a lock piston and a bypass piston, the lock piston being movable relative to the bypass piston in response to the pressure differential between the chamber and the bore.

10. The downhole apparatus of claim 9, wherein the lock piston is configured to engage the bypass piston and push the bypass piston in response to a pressure in the bore communicated through the second port.

11. The downhole apparatus of claim 10, wherein the body further defines a third port, and the bypass piston comprises a bypass port, the bypass port aligning with the third port when the lock piston pushes the bypass piston.

12. The downhole apparatus of claim 11, wherein the bypass piston further comprises a rupture disk positioned in the bypass port.

13. The downhole apparatus of claim 11, further comprising a sliding sleeve in communication with the third port via a flowpath extending through the bypass port, when the bypass port is aligned with the third port.

14. The downhole apparatus of claim 10, wherein the second piston further comprises a locking dog, the locking dog being positioned in a recess formed in the bypass piston when the second piston is in the first position, and the locking dog being at least partially in a recess formed in the lock piston when the second piston is in the second position.

15. A method of actuating a downhole apparatus in a wellbore, comprising:

increasing a pressure of at least a portion of the wellbore to a first fluid pressure, wherein the first fluid pressure is communicated into a chamber of the downhole apparatus;

reducing the pressure in the at least a portion of the wellbore from the first fluid pressure to a second fluid pressure, wherein the chamber is held substantially at the first fluid pressure, causing a pressure differential to be applied to a piston of the downhole apparatus that is in communication with the chamber, wherein the piston moves in response to the pressure differential, opening a fluid passageway; and actuating the downhole apparatus by pumping fluid through the fluid passageway after opening the fluid passageway.

16. The method of claim 15, wherein increasing the pressure in the at least a portion of the wellbore to the first fluid pressure comprises pressure testing a casing in the wellbore for a predetermined length of time.

17. The method of claim 15, wherein actuating the downhole apparatus by pumping fluid through the fluid passageway includes pumping fluid through the opened fluid passageway at a pressure less than the first fluid pressure.

18. The method of claim 15, wherein actuating the downhole apparatus by pumping fluid through the fluid passageway includes pumping fluid through the fluid passageway at a pressure less than a casing testing pressure.

19. A downhole apparatus, comprising:

a body defining a bore, a first port extending radially therein, and a chamber;

a first piston positioned in the chamber, wherein the first piston is movable from an open position to a closed position, wherein the first piston in the open position permits fluid pressure communication from the bore to the chamber via the first port, and wherein the first piston in the closed position prevents fluid pressure communication between the bore and the chamber via the first port; and a second piston positioned in the chamber, wherein the second piston is movable from a first position to a second position at least partially in response to a pressure differential between the chamber and the bore.

20. The downhole apparatus of claim 19, wherein body defines a second port, the second piston in the first position seals with the body and prevents fluid communication between the chamber and the bore via the second port, and the second piston in the second position permits fluid communication through the second port.

21. The downhole apparatus of claim 20, wherein the body further defines a third port extending radially therein and in fluid communication with the bore, wherein the second piston comprises a lock piston and a bypass piston, and wherein:

the lock piston seals with the body to prevent fluid communication with the chamber when the second piston is in the first position, and allows fluid communication with the chamber when the second piston is in the second position; and the bypass piston prevents fluid communication through the third port when the second piston is in the first position, and allows fluid communication through the third port when the second piston is in the second position.

22. The downhole apparatus of claim 19, wherein the body comprises an inner mandrel and an outer housing, the inner mandrel and the outer housing defining the chamber therebetween, wherein the first and second pistons are positioned between the inner mandrel and the outer housing.

* * * * *